United States Patent [19]

Weinberg

[11] 4,396,854

[45] Aug. 2, 1983

[54] IGNITION PLUG

[75] Inventor: Felix J. Weinberg, London, England

[73] Assignee: Lucas Industries Limited, Birmingham, England

[21] Appl. No.: 181,747

[22] Filed: Aug. 27, 1980

[30] Foreign Application Priority Data

Sep. 4, 1979 [GB] United Kingdom ..... 7930650

[51] Int. Cl.[3] ..... H01T 13/02; H01T 13/20

[52] U.S. Cl. ..... 313/120; 313/143

[58] Field of Search ..... 313/120, 143

[56] References Cited

U.S. PATENT DOCUMENTS

| | | | |
|---|---|---|---|
| 1,377,407 | 5/1921 | Depew | 313/120 X |
| 3,057,159 | 10/1962 | Benedict | 313/120 X |
| 3,521,105 | 7/1970 | Franks | 313/120 |

*Primary Examiner*—Alfred E. Smith

*Attorney, Agent, or Firm*—Holman & Stern

[57] ABSTRACT

An ignition plug for use in association with a cylinder of an internal combustion engine wherein within the body of the plug is a chamber having associated therewith first and second electrodes between which a spark is struck in the chamber. A supply arrangement is provided for supplying plasma medium in liquid form to wet the wall of the chamber therewith between successive firings of the plug.

8 Claims, 2 Drawing Figures

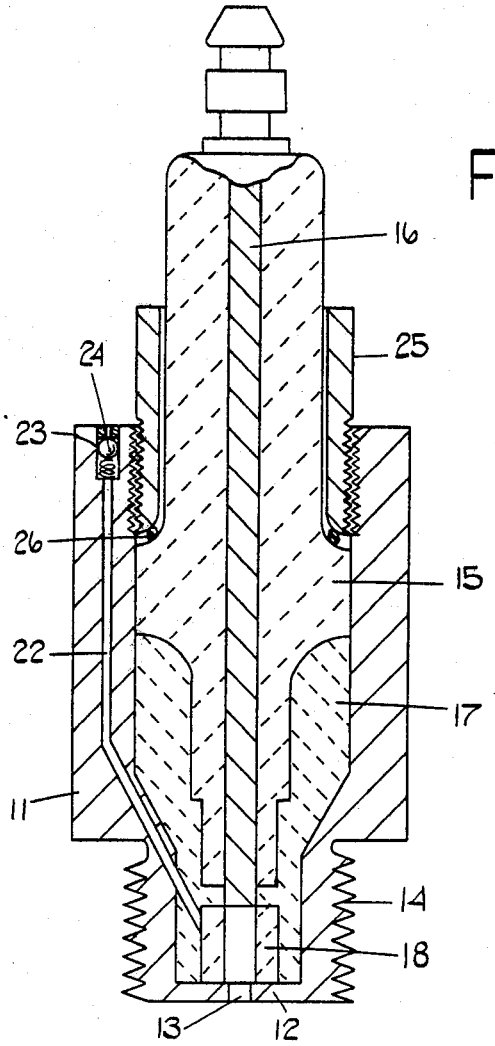
FIG. 1.
FIG. 2.
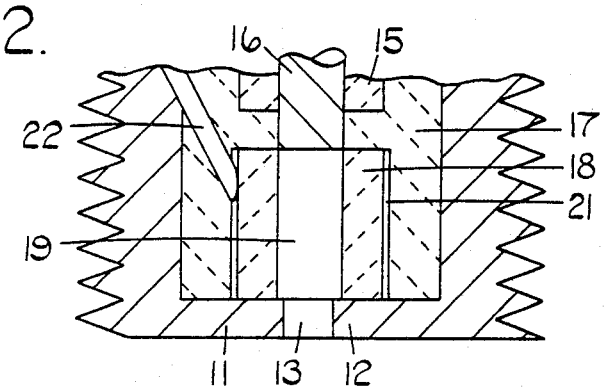

IGNITION PLUG

FIELD OF THE INVENTION

This invention relates to ignition plugs particularly but not exclusively for use in internal combustion engine.

DESCRIPTION OF THE PRIOR ART

It is currently recognized that it is desirable to be able to operate an internal combustion engine using fuel/air mixtures weaker than those which are at present considered to be usual. It is known however that there are problems in igniting and ensuring efficient combustion of weak mixtures.

It has previously been proposed to ensure successful combustion of weaker mixtures by using, as the source of ignition, a plasma jet or stream of radicals, free atoms and/or other excited species, and such a concept is disclosed in an article in the magazine "Nature", Volume 272, No. 5651, pages 341–343, Mar. 23, 1978. This article does not however disclose an ignition plug which is suitable for use in a practical application in an internal combustion engine. The plug which is disclosed in the article is a plug capable of use only for experimental purposes.

In the past, in order to create a plasma jet it has been considered necessary to provide a gaseous or vaporized plasma medium within which the initiating spark is struck. In a practical internal combustion engine it is considered that the provision of ancillary apparatus for storing and supplying gaseous or vaporized medium would be undesirable to, for example, road vehicle manufacturers, and it is an object of the present invention to provide an ignition plug wherein this problem is minimized.

BRIEF SUMMARY OF THE INVENTION

An ignition plug according to the invention is intended for use in association with a cylinder of an internal combustion engine and includes a body having therein a chamber, first and second electrodes between which, in use, a spark is struck in the chamber, and means for supplying plasma medium in liquid form to the wall of said chamber such that between successive firings of the plug at least a circumferential region of the wall of said chamber, between said first and second electrodes, is wetted with liquid plasma medium.

Preferably substantially the whole of the circumferential surface of the wall of the chamber between said first and second electrodes is wetted with liquid plasma medium between successive firings of the plug.

Desirably at least said circumferential region of the wall of said chamber is defined by the inner surface of a porous annular member the outer surface of which is supplied with liquid plasma medium by way of a conduit in said body.

Preferably the outer surface of said porous annular member defines part of the wall of an annular gallery within the body of the plug, liquid plasma medium being supplied to the gallery by way of said conduit.

Desirably said first electrode is positioned at one, closed axial end of the chamber, and the second electrode is positioned at the opposite, open axial end of the chamber.

Conveniently said second electrode is annular, and partially closes said opposite axial end of the chamber.

BRIEF DESCRIPTION OF THE DRAWINGS

One embodiment of the invention is illustrated in the accompanying drawings, wherein;

FIG. 1 is a diagrammatic cross-sectional view of an ignition plug; and

FIG. 2 is a much enlarged view of part of the plug shown in FIG. 1.

DETAILED DESCRIPTION

Referring to the drawings, it can be seen that the ignition plug has a basic structure similar to a conventional spark ignition plug. The plug includes a metallic sleeve 11 partially closed at one end by an integral base 12 having a central aperture 13. Adjacent the base 12 the sleeve is generally cylindrical and is provided with an external screw thread 14 whereby the plug may be secured in position in the cylinder head of a cylinder of an internal combustion engine. Secured within, and closing the opposite end of the sleeve 11 is a ceramic insulator 15 within which is secured an axially extending metallic electrode rod 16.

Between the innermost end of the insulator 15 and the base 12 the sleeve 11 contains an insulating insert 17 which is shaped adjacent the base 12, to define with the base 12 a cavity housing an annular porous sintered member 18.

The porous member 18 is annular and of circular cross-section, has its axis co-extensive with the axis of the sleeve 11, and to central bore aligned with and communicating with the aperture 13. The central electrode rod 16 extends at its outer end from the insulator 15 so that an external electrical connection can readily be made to the electrode rod 16, and at its opposite end the electrode rod 16 terminates at the innermost end of member 18 closing the central bore of the member 18. The central bore of the member 18 is of larger diameter than the aperture 13, and thus defines within the plug a chamber 19 closed at its inner end by the electrode 16 and partially closed at its outer end by the base 12.

The outer diameter of the member 18 is somewhat less than the inner diameter of the cavity defined by the insert 17, so that between the wall of the cavity, and the outer surface of the member 18 there is defined an annular gas or space 21. The sleeve 11 and insert 17 are formed with a passage or conduit 22 terminating at one end in a supply union 23 at the exterior of the sleeve 11, and terminating at the other end in the annulus 21. The supply union 23 is provided with a non-return valve 24.

The insert 17 abuts the inner surface of the base 12, and the insulator 15 abuts the insert 17. The insulator 15 and insert 17 are secured within the sleeve 11 by a clamping bushing 25 which encircles the insulator 15 and is in screw threaded engagement with the sleeve 11. The bushing bears against a flange on the insulator 15 to apply clamping pressure thereto, and a seal 26 is incorporated between the bushing 25 and the flange of the insulator 15 to seal the interface between the sleeve 11 and the insulator 15.

It will be recognised that as with a conventional spark ignition plug the metallic sleeve 11 forms the ground electrical connection to the plug, the base 12 of the sleeve defining the second electrode of the plug.

In use plasma medium in liquid form is supplied from a reservoir by way of the non-return valve 24 to the passage 22, and fills the passage 22 and annulus 21. The porous member 18 becomes soaked with the liquid, which seeps from the pores which open into the central bore of member 18 so that the whole of the surface of the chamber 19 is wetted with the liquid plasma medium. In order to fire the plug an electrical spark is struck between the electrode 16 and the second electrode defined by the base 12, by applying a high voltage between the electrode 16 and the sleeve 11. The spark so generated extends momentarily along the whole length of the chamber 19, and the film of plasma medium in liquid form on the circumferential wall of the chamber 19 is immediately vaporized. In known manner the spark discharge generates plasma in the now vaporized plasma medium in the chamber 19 and a jet of extremely hot plasma issues from the chamber 19 by way of the aperture 13. In use this jet of extremely hot plasma passes into the fuel/air charge which has previously been compressed in the cylinder of the internal combustion engine thus igniting the charge so that the associated piston of the internal combustion engine is driven downwardly to perform its power stroke.

The plasma jet issuing from the plug promotes efficient ignition and combustion of weaker fuel/air mixtures than can successfully be ignited by a conventional spark ignition plug.

It is found that a wide variety of plasma mediums can be utilized as will be apparent to those familiar with plasma technology. Water is a suitable medium, and also a variety of mixtures of engine fuel and alcohol are highly effective. The supply to the passage 22 from the reservoir of the liquid plasma medium can be by means of a gravity feed, although if desired a pressurized supply can be provided in any convenient manner, for example by using a pressurized reservoir. The non-return valve 24 ensures that during the compression and ignition cycles in the cylinder of the engine the larger increase in pressure in the chamber 19 does not drive the plasma medium, and gaseous combustion products, through the member 18 and into the annulus 21 and passage 22.

The porosity of the sinter 18 will of course be determined in relation to the viscosity of the plasma medium and whether or not the plasma medium is gravity or pressure fed. However, the arrangement will preferably be such that the seepage through the pores of the member 18 is just sufficient to provide a wet film of plasma medium on the circumferential surface of the chamber 19 in the period between subsequent compression strokes of the piston of the cylinder with which the plug is associated. Clearly the member 18 will be formed of a material capable of withstanding the temperatures and pressures involved in the ignition process, and obviously will be a material which is not chemically attacked by the plasma medium. In tests utilizing an engine fuel/alcohol mixture as the plasma medium a PYREX glass sinter has been found to be suitable.

Since all that is necessary is to provide the wetting of the circumferential surface of the chamber 19 then it will be recognised that very tiny volumes of liquid plasma medium are consumed during each firing of the plug. It is quite conceivable therefore that a relatively small reservoir can be provided adjacent the internal combustion engine for supplying all of the plugs of a multi-cylinder internal combustion engine and that such a reservoir will only need to be refilled with plasma medium infrequently, for example each time a road vehicle utilizing the engine undergoes a routine service.

It will be recognized that the wetted surface need not be the whole of the surface of the chamber, and that the member 18 could define an axially discreet circumferential region of the chamber surface. Moreover, in order to provide a chamber within which the plasma is generated, and which prior to plasma generation has a circumferential region of its wall wetted with liquid plasma medium, it may not be essential to utilize a porous annular member such as 18. It is possible for example that the wall of the chamber 19 might be non-porous, and might be encircled by an annulus filled with plasma medium in liquid form, and communicating with the chamber wall at its upper end through a plurality of radial drillings of very small diameter spaced around the circumference of the wall. In such an arrangement seepage of the plasma medium would occur through the drillings, and would spread, on the wall of the chamber, to form a circumferentially and axially extending film.

I claim:

1. An ignition plug intended for use in association with a cylinder of an internal combustion engine, comprising a plug body, a first electrode, means to support said first electrode by said body, a second electrode disposed on said body in spaced relationship to said first electrode, a porous annular member in said body, a chamber having a wall which is at least in part a circumferential surface defined by the inner surface of said porous annular member in a position with respect to said electrodes so that firing of said plug produces a spark in said chamber between said electrodes, a conduit in said body communicating with the outer surface of said porous annular member for supplying plasma medium in liquid form to said chamber, said porous annular member distributing said plasma medium to said wall of said chamber so that between successive firings of the plug at least a part of said circumferential surface of the wall of said chamber between said electrodes is wetted with liquid plasma medium, and means to provide communication between said chamber and said cylinder.

2. An ignition plug as claimed in claim 1, wherein substantially the whole of said circumferential surface of the wall of the chamber between said first and second electrodes is wetted with liquid plasma medium between successive firings of the plug.

3. An ignition plug as claimed in claim 2, wherein the whole of said wetted wall of the chamber is defined by the inner surface of said porous annular member.

4. An ignition plug as claimed in claim 3, and further comprising an annular cavity within said body of the plug the walls of which are defined at least in part by said outer surface of said porous annular member, and said conduit communicates with said annular cavity.

5. An ignition plug as claimed in claim 1, and further comprising an annular cavity within said body of the plug the walls of which are defined at least in part by said outer surface of said porous annular member, and said conduit communicates with said annular cavity.

6. An ignition plug as claimed in any one of claims 1, 2, 3, 5 or 4 wherein said first electrode is positioned at one axial end of said chamber to thereby close said one end, the second electrode is positioned at the opposite, open axial end of said chamber and said communication means is adjacent said opposite, open axial end.

7. An ignition plug as claimed in claim 6, wherein said second electrode is annular and partially closes said opposite, open axial end of said chamber.

8. An ignition plug as claimed in claim 1 wherein said plug body comprises a hollow cylindrical electrically conducting member having external threads on one end adapted to engage in the threaded spark plug receiving holes of the engine and internal threads at the other end, said communication means comprises an axial hole in said one end, said means to support said first electrode comprises a first insulator disposed within said plug body which together with said first electrode closes said other end thereof, said plug further comprising a second insulator disposed within said plug body between said first insulator and said one end having a recess in the end thereof adjacent said one end, a retaining bushing threadedly engaging said internal threads on said other end for retaining said first insulator in said plug body, sealing means between said bushing and said first insulator to seal the hollow interior of said plug body, said annular porous member being disposed within said recess in said second insulator, said chamber comprising the central opening in said annular member coaxially aligned with said plug body and communicating at its end adjacent said one end of said plug body with said axial hole, said axial hole being smaller in diameter than said central opening in said annular member, said annular member having a smaller outer diameter than the internal wall of said recess to provide a substantially annular space therebetween, said plasma medium supply conduit comprising a hollow conduit extending from the outer surface of said plug body through said plug body and said second insulator to said annular space, and said first electrode comprises an elongated electrically conducting rod extending through said insulators and engaging at its inner end with the other end of said central opening of said annular member to thereby close it, the outer end of said first electrode having a spark plug wire connector thereon, and said second electrode comprises said one end of said plug body.

* * * * *